United States Patent [19]

Furui et al.

[11] 4,168,966

[45] Sep. 25, 1979

[54] AGGLOMERATES FOR USE IN A BLAST FURNACE AND METHOD OF MAKING THE SAME

[75] Inventors: Takeo Furui; Katsuhiko Sato, both of Kitakyushi, Japan

[73] Assignee: Nippon Steel Corporation, Tokyo, Japan

[21] Appl. No.: 831,599

[22] Filed: Sep. 8, 1977

Related U.S. Application Data

[63] Continuation of Ser. No. 650,063, Jan. 19, 1976, abandoned.

[30] Foreign Application Priority Data

Jun. 14, 1975 [JP] Japan ..... 50/71431

[51] Int. Cl.[2] ..... C21B 1/24

[52] U.S. Cl. ..... 75/3; 75/41; 75/257

[58] Field of Search ..... 75/3, 41, 42, 30, 257

[56] References Cited

U.S. PATENT DOCUMENTS

| | | | |
|---|---|---|---|
| 3,189,436 | 6/1965 | Burstlein | 75/3 |
| 3,374,085 | 3/1968 | Stone | 75/3 |

*Primary Examiner*—M. J. Andrews

*Attorney, Agent, or Firm*—Toren, McGeady and Stanger

[57] ABSTRACT

Agglomerates for use in a blast furnace containing a cementitious material and formulated to maintain the CaO to $SiO_2$ ratio in a range of from 1.2 to 1.9 and the slag forming ratio in a range of from 13 to 19% which when charged in a blast furnace assume an improved drafting aspect in the smelting reaction zone. The as-formed discrete moist agglomerates are to be cured without the necessity of a powder matrix prior to introduction to the furnace, whereby an adequate crushing strength is imparted to the agglomerate product to reduce handling difficulties resulting from the production of fines.

9 Claims, 7 Drawing Figures

$$(A'') \frac{\text{amount of powder ore + amount of additives}}{\text{amount of hydraalic binder}}$$

$$(B'') \frac{\text{amount of powder ore}}{\text{amount of water hardening binder + amount of additives}}$$

AGGLOMERATES FOR USE IN A BLAST FURNACE AND METHOD OF MAKING THE SAME

This is a Continuation of application Ser. No. 650,063, filed on Jan. 19, 1976 now abandoned.

BACKGROUND OF THE INVENTION

This invention relates to a charge composition for smelting furnaces, and a method of forming non-fired agglomerates such as pellets or briquettes therefrom which show excellent reducibility and do not interfere with the proper smelting reactions and temperatures.

In order to facilitate the smelting of a charge including finely divided iron ore while preventing the iron ore fines from being scattered about in the smelting furnace and also insuring satisfactory smelting reactions, it has been the prior art practice to form the charge composition into agglomerates such as pellets or briquettes prior to charging to the smelting furnace.

The utilization of pellets or briquettes in a smelting furnace such as a blast furnace is itself not without problems for the reason that the pellets formed from the charge composition are frequently found to possess an inadequate crushing strength for convenient handling from a travelling grate system to a furnace smelting system as well as for the smooth smelting procedure in which the charged pellets are forced to move downward under the action of gravity and the weight of the pellets accomulated thereon, thereby an excessive amount of fines tend to be formed in the smelting furnace.

One approach to the impartment of an adequate crushing strength to the pellets or briquettes is that the finely divided iron ore is mixed with limestone, coal and bentonite as a binder, and the mixture after, if necessary, moistened with a proper amount of water is agglomerated and then fired at elevated temperatures as high as several hundreds of centigrades to produce indurated pellets or briquettes. This method, however, has a drawback resulting from the provision of the firing step which makes complicated the process for producing iron from the iron ore and consequently increases the production cost of iron. Another drawback is that the gas discharged from the firing step contains poisonous compounds such as $SO_x$ and $NO_x$ which must be removed, or otherwise they would pollute the environment of air.

Many attempts have been made to eliminate the firing step from the processing operation for the production of indurated pellets or briquettes and a technique has been proposed to provide non-fired pellets or briquettes having a crushing strength large enough to prevent an unacceptably excess amount of fines from being produced from the pellets or briquettes during the travelling and smelting operations. For example, the finely divided ore is blended with a binder having a hydraulic property such as Portland cement clinker, then the blend after moistened is formed into discrete moist pellets, and then the pellets are cured as buried in a power matrix which may be identical in material to the used ore. This agglomerate composition of nonfired pellets and the process for making same, however, have much to be desired, which is explained in more detail below.

The prior art non-fired pellets, though having a crushing strength not inferior to that of the fired pellet at ordinary temperature, are found to have inferior reducibility and interfere with the proper smelting reactions and temperatures, because of the scabbing and premature softening phenomena of the pellets occurring as the temperature of the smelting zone ranges from 500° to 1,400° C. The prior art process for making non-fired pellets, on the other hand, as, for example, disclosed in Japanese Patent Publication No. Sho 46-32324, includes a curing step in which the as-formed discrete moist pellets are burried in ore powders as a matrix to avoid the adhesion of the pellets with one another until the cementitious material is completely cured. After the curing has been completed, it is necessary to rid the pellets of the ore powder by means of screening. However carefully the screening is carried out, it is difficult to reduce to zero the residual amount of ore fines adhering to the surfaces of the pellets which when charged into a smelting furnace such as a blast furnace tends to reject some of the adhered ore fines. When the rejected ore fines are accumulated in the furnace, it is found that the degree of passability of forced air or oxygen draft is gradually decreased, and that when the amount of fines produced is excessive, the handling difficulties becomes serious. Furthermore, the screening operation is very time-consuming, and the necessary iron ore powder as the matrix amounts to more than 30% based on the total weight of the charge pellets.

Accordingly, the present invention has for the general object to eliminate the above mentioned conventional drawbacks, and to provide non-fired agglomerates which do not interfere with the proper smelting reactions, and a process for making non-fired agglomerates without the necessity of using the powder matrix which would be otherwise necessary to prevent the adhesion of the pellets during the curing operation.

To achieve this, at first, the composition of agglomerates such as pellets and briquettes is formulated so that the ratio $CaO/SiO_2$ is in a range of from 1.2 to 1.9, and the amount of slag forming material is in a range of 13% to 19% based on the total weight of the non-fired agglomerate, whereby the drafting aspect of the indurated pellets or briquettes in the smelting zone are improved.

Secondary, the present invention has an object to improve the properties of the agglomerates by adjusting the composition, namely the $CaO/SiO_2$ ratio and the proportion of the slag forming material through blending of iron ores.

Thirdly, the curing of the as-formed discrete moist agglomerate such as pellets or briquettes is carried out without using any powder matrix to impart excellent high-temperature properties to the resultant cured agglomerates without sacrificing the reducibility of the agglomerate charge, whereby the handling difficulties of the pellets or briquettes due to the adhesion of fines are minimized.

For the purpose of furthermore reducing the possibility of assuming the adhering aspects of the moist pellets during the curing operation with no matrix, an overcoating of an inorganic substrance is applied around each of the moist pellets before subjecting the curing operation.

Fourthly, the present invention has an object to provide an improved agglomeration method which can give satisfactory agglomerates without using any powder matrix during the curing.

These and other features of the present invention will be more readily understood when the following description is read in connection with the accompanying drawings.

SUMMARY OF THE INVENTION

The present invention is characterized in that a mixture is prepared by mixing and grinding iron ore powder, additives and hydraulic binder in a proportion so as to assure high-temperature properties of resultant agglomerates, or by mixing and grinding the required total amount of water-hardening binder with parts of iron ore powder and additives and mixing the resultant mixture with the remaining amounts of iron ore powder and additives or by mixing and grinding the required total amounts of hydraulic binder and additives with a part of iron ore powder and mixing the resultant mixture with the remaining amount of iron ore powder, and then the mixture obtained above is moistened and agglomerated.

The hydraulic binder used in the present invention includes portland cement, portland cement clinker, alumina cement, alumina cement clinker, cement mixed with blast furnace slag, cement mixed with fly ash, cement mixed with borazon and masonry-mixed cement.

The additives used in the present invention includes silica stone, beach sand, shirasu, blast furnace slag, electric furnace slag, dust from ferro-silicon production, serpentine, peridotite, limestone, quick lime, slabed lime, dolomite, converter slag, etc.

DESCRIPTION OF THE PREFERRED EMBODIMENTS

Figure 1:
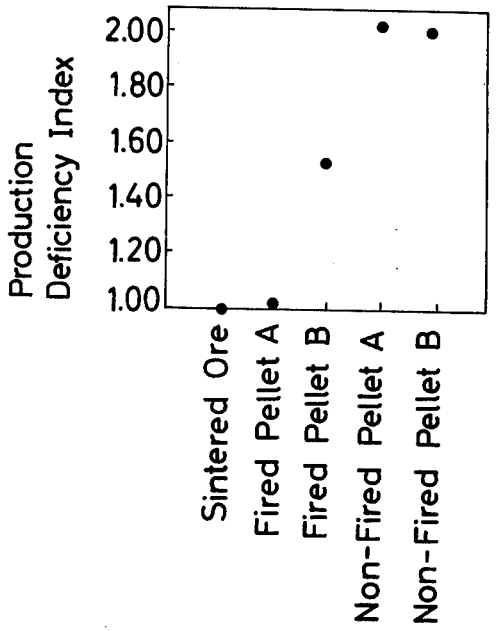
FIG. 1 is a graph showing the production deficiency as a function of the type of the charge composition according to the prior art, wherein the ordinate is in production deficiency index, and the sintered iron ore is taken as a reference charge composition and has therefore unit index.

In the blast-furnace process, the iron-bearing materials including pellets and briquettes are charged into the blast furnace from the top thereof and are reduced during their downward movements in the blast furnace, and soften and melt down due to increased furnace temperature and pressure imposed thereon. Approaching the bottom of the furnace, the particular section of the charge enters a softening zone from which it proceeds to the smelting reaction zone and is ultimately to form into both liquid iron and liquid slag. When the softening zone operates in a relatively lower temperature range and when the temperature range is relatively wider with a longer distance along the furnace, a higher pressure for the blast air must be employed, or otherwise the reduction reactions would be retarded and the temperature distribution would be made uneven to result in a decrease of production efficiency. Based on this fact, it is preferred to evaluate the quality of the charge in terms of production deficiency index. In practice, the production deficiency index is determined in such a manner that at first a reference charge is processed under a certain production efficiency to measure the correspondingly necessary pressure of air blast, and then a given charge is processed with an air blast equivalent in pressure to the previously measured one to derive a production deficiency index value by dividing the former or reference production efficiency by the resultant one. As shown in FIG. 1, two charge compositions of non-fired pellets have production deficiency index values as high as two and higher than those of fired pellets.

For improving the quality of non-fired pellets with respect to the production efficiency, the present inventors have conducted various experiments and have now found a mechanism of causing such increases in the production deficiency index value of the pellets. This mechanism depends upon the following two main factors: (1) A "scabbing" phenomenon occurs which leads to an apparent softening effect of the pellets; and (2) a Fe-silicate slag material having a relatively lower melting point is formed in a large proportion to the total charge weight to cause the premature softening effect of the pellets.

Therefore, in order to produce non-fired agglomerates such as pellets and briquettes having excellent load-softening property, it is enough to prevent the softening due to the above factors. Regarding the softening due to the scabbing, it is natural that the scabbing phenomenon itself must be surpressed, and the softening due to the factor (2) can be prevented by increasing the basicity of the whole charge so as to melting of FeO into the slag.

On the basis of this discovery, the present invention contemplates to improve the properties of the charged pellets in the softening zone of the smelting furnace by suppressing the softening tendency of the non-fired pellet attributable to these factors. As is well known in the art, the scabbing material is iron which is formed on the surfaces of the pellets when the pellet is heated to about 900° C. in a CO atmosphere, and the occurrence of this scabbing phenomenon is limited to that area of the surface of the pellet which is occupied with the exposure surfaces of iron ore particles contained in the pellets.

According to the present invention, the part of the softening tendency of a pellet ascribable to the first-named factor or "scabbing" phenomenon is suppressed by minimizing the proportion of the sum of the exposed areas of iron ore particles at the surface of the pellet. By reference to FIG. 2 it is to be understood that a high quality iron ore designated by "A" analyzing about 2.0% $SiO_2$, when formulated with 9% cementitious binder provides a pressure loss value of more than 900

$mmH_2O$ which may be considered to depend upon that part of the softening tendency which is attributable to the "scabbing". This is mainly because (1) those constituents of the charge composition which are to form slag materials occupy so small a volume corresponding to a weight of 10.6% that the sum of the exposed areas of iron ore particles is relatively large as compared with the entire surface of the pellet; and (2) the CaO to $SiO_2$ ratio is as high as 1.6, which is unfavorable for formation of slag materials in the reducing reaction zone, so that it is made more difficult to suppress the increase of the sum of the exposed areas of iron ore particles. With such an iron ore, therefore, the present invention provides means of adjusting for the concentration of slag-forming constituents as well as for the $CaO/SiO_2$ ratio in the slag, namely, the basicity. It is to be noted that although the slags produced in the well known blast furnaces are generally found to contain MgO besides CaO, $Al_2O_3$ and $SiO_2$, the term "slag-forming constituents" herein used is to exclude MgO, because it does not contribute to the slag formation so long as the temperature is maintained at a low level of about 1,000° C.

Figure 2:
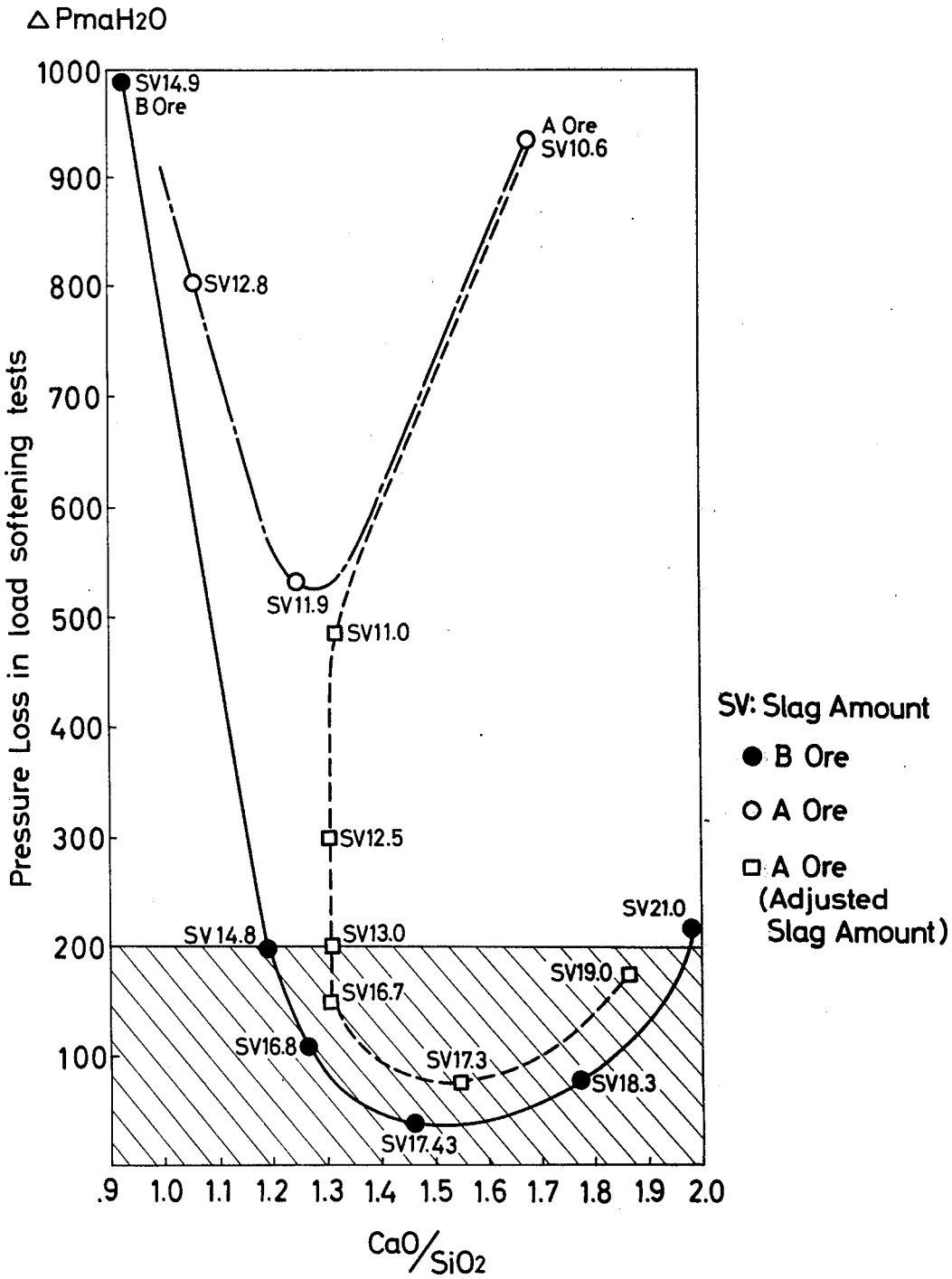
FIG. 2 is a graph showing the degree of softening tendency of a non-fired pellet as a function of the CaO to $SiO_2$ ratio with the amount of slag produced on smelting being taken as a parameter, wherein the degree of softening tendency is expressed in terms of pressure loss in forced air draft, and the slag is taken as consisting of CaO, $SiO_2$ and $Al_2O_3$.

With reference to FIG. 2, as the basicity is decreased with increase in the amount of $SiO_2$ added, the pressure loss of a resulting charge composition containing the iron ore "A" is decreased, reaching a minimum value of about 500 $mmH_2O$ at a basicity of about 1.3, and then increased to more than 900 $mmH_2O$, as indicated by the dot-and-dash curve. The reason why the pressure loss increases as the basicity is decreased from 1.3 is that the solubility of FeO in the Fe-Silicate slag increases with increase of the amount of low-melting point slag which constitutes the other part of the softening tendency which is ascribed to the second-named factor as mentioned above. For this reason, according to the present invention, while maintaining the basicity constant at a level of 1.3, the concentration of the slag-forming constituents is increased to more than 13.0% in order to insure that the pressure loss value falls in a range below 200 $mmH_2O$ as indicated by the oblique lines. This range is confined with the acceptable range for the typical conventional fired pellets. In the case of the iron ore "A", the increase of weight proportion of the produced slag is effected by previous addition of additional granulated blast furnace slag to the charge composition prior to the pelletizing procedures.

In the case of another type of iron ore designated by "B" analyzing about 5% $SiO_2$, a charge composition formulated by adding 9% cementitious binder to the fines of iron ore "B" provides non-fired pellets having a softening tendency of more than 1,000 $mmH_2O$ in pressure loss, as shown by the solid curve in FIG. 2. This is because the amount of slag-forming constituents is as high as 15% based on the total weight of the charge, and because the basicity is as low as 0.9. Such a situation promotes the reaction of the slag-formable constituents with FeO at relatively lower temperatures of a range in which the reducing reaction zone operates, thereby causing a relatively larger amount of Fe-Silicate slag to be formed and therefore causing a large amount of the so-called low-melting point slag. In this connection, it is to be noted that the occurrence of the "scabbing" phenomenon is negligible because the exposure of the iron ore particles out of the pellet surfaces is suppressed as the low-melting point slag is produced in excess. With this type of iron ore, according to the present invention, a CaO-source material or materials is or are formulated into a charge composition prior to the pelletizing procedures to account for the adjustment of basicity $CaO/SiO_2$. As the amount of the CaO-source material added is increased to increase the basicity from 0.9, the pressure loss of the pellet charge is decreased entering the acceptable range below 200 $mmH_2O$ at a basicity of 1.2. The basicity may be increased to as high as 1.9 to effect acceptable results, and there is no need to increase the basicity from 1.9 as the possibility of encountering situations requiring the adjustment of basicity to more than 1.9 is very small in practice. In addition thereto, the solid and dashed curves indicate that the pellet charge with a basicity of more than 1.9 tends to deteriorate the drafting aspect. The charge composition consisting of iron ore "B" and 9% cementitious binder provides slag-forming constituents in an amount of about 15% which is more than enough to account for the suppression of occurrence of the scabbing phenomenon. In this respect, an additional increase in the concentration of the slag-forming constituents caused by the adjustment of the basicity is not intended, but the concentration of slag-forming constituents in a charge composition of the present invention may be increased to as large as 19% inasmuch as the pressure loss of the resulting pellet charge falls in the acceptable range below 200 $mmH_2O$.

It will be appreciated from the foregoing that the present invention contemplates to formulate a charge composition prior to the pelletizing operation as having a basicity in a range of from 1.2 to 1.9 by addition of additional CaO- and/or $SiO_2$-source materials or material, and as having slag-forming constituents in a range of form 13% to 19% by addition of an additional slag-source material.

As a binder having a hydraulic property, use may be made of Portland cement, Portland cement clinker, alumina cement, alumina cement clinker, blast furnace slag mixed cement, fly ash-mixed cement, pozzolan-mixed cement and masonry-mixed cement. As a CaO-source material, use may be made of limestone, hydro cake, and dolomite. As a $SiO_2$-source material, use may be made of seashore sand, periodotite, serpentine, fire brick chips and acid slag. As an additive for increasing slag percentage, use may be made of the above mentioned materials and blast furnace slag or blast furnace granulated slag.

For exemplary purposes, a number of formulations based on the principle of the invention will be next illustrated which may be used in the pelletizing process of the invention to be described later.

EXAMPLE I

Use was made of two iron ores, the one (A) of the ores analyzing a lower content of $SiO_2$ being supplied from the magnetite series after concentrated by magnetic separation, and the other ore (B) from the hematite group after pulverized. The iron ores A and B were mixed with Portland cement, limestone, white sand and blast furnace granulated slag in the following proportions.

Table 1

| Sample No. | Iron ore (%) | Blast furnace charge composition: Portland cement(%) | Lime-stone(%) | White sand(%) | Slag added (%) | Basicity ($CaO/SiO_2$) | Final slag (%) |
|---|---|---|---|---|---|---|---|
| 1 | 88.3 (Ore A) | 9.0 | — | 2.7 | — | 1.23 | 13.0 |
| 2 | 84.3 (Ore A) | 9.0 | — | 1.6 | 5.1 | 1.27 | 17.0 |
| 3 | 85.9 (Ore B) | 9.0 | 2.5 | — | — | 1.25 | 17.4 |
| 4 | 87.4 (Ore B) | 9.0 | 3.6 | — | — | 1.54 | 18.3 |
| 5 | 85.9 (Ore B) | 9.0 | 5.1 | — | — | 1.81 | 19.7 |
| 6 | 91.0 (Ore A) | 9.0 | — | — | — | 1.62 | 10.8 |
| 7 | 91.0 (Ore B) | 9.0 | — | — | — | 0.95 | 15.0 |

Note: Samples No. 6 and No. 7 are in the prior art.

In this example, the process for forming non-fired pellets from the charge composition was carried out in the following manner; (1) Each of these composition samples was grounded in a batch type ball mill for ten minutes; (2) The grounded mixture is formed into discrete moist pellets by using a laboratory pelletizer of the tire type (550 mm in diameter with 200 mm long) operated at a speed of 30 r.p.m.; and (3) The moist or green pellets were cured at ordinary temperature for 7 days and then dried prior to the reduction test.

Reduction test: Using these charge compositions of indurated pellets, the production deficiency index was computed based on the data obtained by the reduction test, and the results are shown in FIG. 3, wherein the solid circle marks are for the ore A, marks, x, for ore B, and the blank circle marks are for the prior art.

Figure 3:
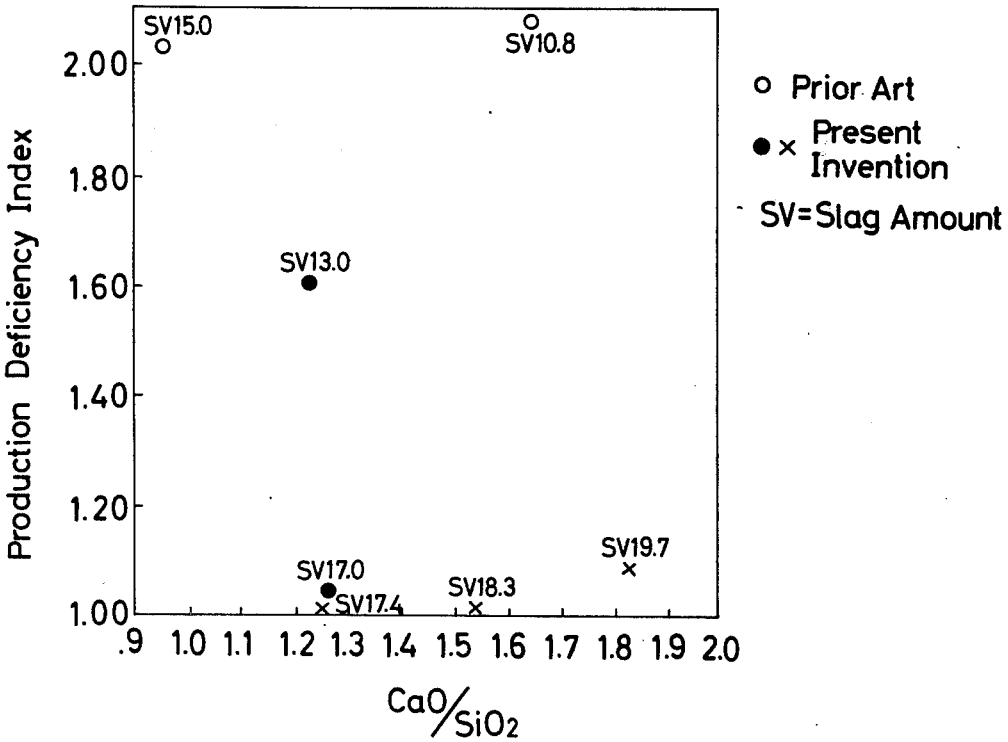
FIG. 3 is a graph showing the production deficiency as a function of $CaO/SiO_2$ in a pellet produced in accordance with the present invention in comparison with that according to the prior art.

It is evidenced from FIG. 3, that the pellets of the present invention are far superior to those of the prior art in respect to the load softening property, and, therefore, in the non-interference with the proper smelting reactions and temperatures, as the air drafting aspect of the pellets charged in a blast furnace is improved by suppressing the scabbing and/or by decreasing the amount of low-melting point slag produced therein.

It is known that the activity of the $SiO_2$ added in the charge composition differs with different types of natural material or by-products which are employed as the source of $SiO_2$ and with the particle size thereof, but the present inventors have now found that the $SiO_2$-source gangue material dispersed in iron ores exhibits a very high activity of $SiO_2$. This finding of the invention leads to an effectiveness of blending a type ground iron ore having $SiO_2$ in a relatively high concentration with another type of ground iron ore having Fe in a relatively higher concentration and $SiO_2$ in a relatively lower concentration than those of the former type iron ore. This blending method provides several advantages, one of which is to minimize the amount of addition of additional high-active and accordingly expensive $SiO_2$-source material, another one which is to avoiding the complexity of the iron ore processing operation due to the provision of a step of adding such $SiO_2$-source material to formulate a charge composition, or otherwise of a step of decreasing the particle size of a $SiO_2$-source material which is to be added thereto, and still another one which is to prevent the amount of slag-formable constituents from being increased in a resulting charge composition which would be otherwise effected by the addition of the additional $SiO_2$-source material.

In order to materialize such an effectiveness of the blending, an experiment has been made using four types of iron ore designated A', B', C' and D' analyzing Fe and $SiO_2$ in contents as shown in Table 2 below.

Table 2

| Sample No. | Ore | Total Amount of $SiO_2$ content: Fe contained (%) | (%) |
|---|---|---|---|
| A' | High-Fe iron ore | 69.0 | 0.59 |
| B' | Middle-$SiO_2$ red iron ore | 62.7 | 4.78 |
| C' | High-$SiO_2$ magnetite | 64.46 | 8.54 |
| D' | Middle-$SiO_2$ limonite | 57.5 | 5.96 |

Figure 4:
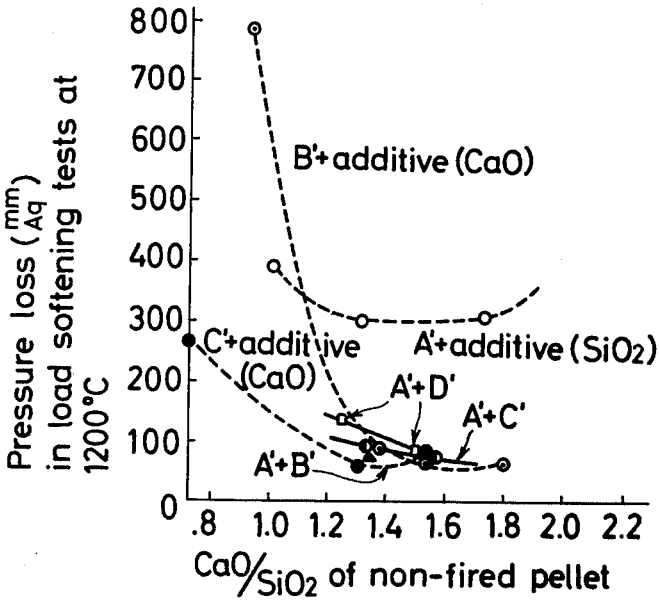
FIG. 4 is a graph showing the effectiveness of iron ore-blending on the pressure loss at 1,200° C. with variation of $CaO/SiO_2$ of non-fired pellets.

In this experiment, these four types of iron ore were processed in the single or blended form with 9% Portland cement and either of additional $SiO_2$-source and CaO-source materials to produce a number of speciments of non-fired pellets with variation of $CaO/SiO_2$ in a manner similar to that described in connection with Example I, and the results are shown in FIG. 4, wherein the ordinate is in pressure loss at 1200° C., and the abscissa is in $CaO/SiO_2$ or basicity. The three dashed curves represent the use of iron ore in the single form, with the blank circles being assigned to a combination of iron ore A' and additional $SiO_2$, with the dotted blank circules to a combination of iron ore B' and additional CaO, and with the solid circles to a combination of iron ore C' and additional CaO. The solid triangle mark represents a blend of 40% ore A' and 51% ore B'. A solid curve associated with the semi-solid circles represent a blend of ore A' and ore C' in a varied ratio of from 57%/34% to 68%/23% to account for variation of the basicity. Another solid curve associated with blank square marks represents a blend of ore A' and ore D' in a varied ratio of from 46%/45% to 45%/44% with addition of limestone in an amount of 0% to 2% to account for variation of the basicity. With this formulation of the charge compositions of non-fired pellets, the resultant concentration of $SiO_2$ in the pellet is varied with the different six schemes as shown in FIG. 5, wherein the same marks are employed to denote the identical schemes to those of FIG. 4.

Figure 5:
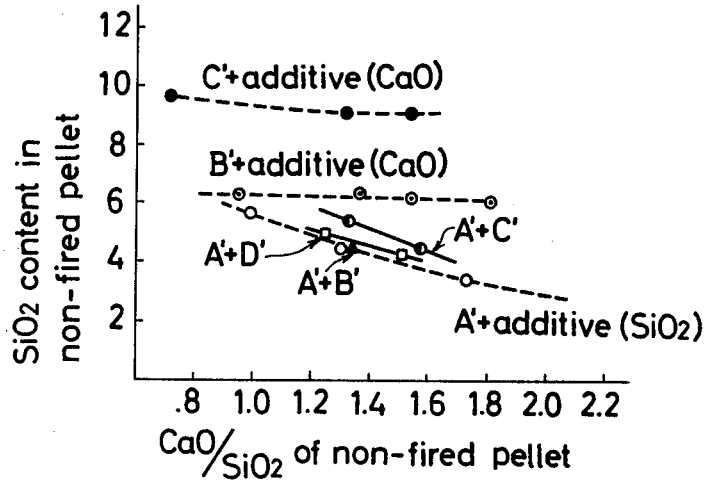
FIG. 5 is a graph showing the dependence of concentration of $SiO_2$ in the non-fired pellet on the source of iron ore for effecting equivalent $CaO/SiO_2$ ratios.

It will be understood from FIGS. 4 and 5 that the activity of $SiO_2$ supplied from any one of the iron ores B', C' and D' is very higher than that of $SiO_2$ supplied from the added $SiO_2$-source material. In more detail, in the case of the high-Fe ore A', the adjustment of $CaO/SiO_2$ to more than 1.2 with addition of a $SiO_2$-source material effects no establishment of the pressure loss value at a level lower than 200 $mmH_2O$. On the other hand, the iron ores B' and C' having $SiO_2$ in high contents result in the rapid decreases of pressure loss values to less than 200 $mmH_2O$ with increase of the basicity up to not less than 1.2. In the latter connection, it is to be noted that the iron ores B' and C' with respective additional CaO-source materials provide slag-forming constituents ($SiO_2+Al_2O_3+CaO$) in an amount of 18% and 21–23% respectively. In this respect, therefore, a charge composition which is formulated from the iron ore A and an additional $SiO_2$-source material must be further supplied with both of $SiO_2$-source and CaO-source materials to increase the amount of the slag-forming constituents to more than 16%, as the charge composition initially contains the slag-formable constituents in an amount of about 11% to 12%. When the high-Fe type of iron ore is given as a raw material for the charge composition of non-fired pellets, therefore, it is preferred to utilize the blending technique of the invention as applied to the charge compositions A'+B', A'+C', and A'+D', whereby the pressure loss values are set in below 200 $mmH_2O$ provided that the basicity is adjusted to not less than 1.2, although the resulting concentrations of $SiO_2$ in the non-fired pellets produced by the blending are almost equal to that of $SiO_2$ in the pellet produced from the iron ore A' and a $SiO_2$-source material without accounting for adjustment of the amount of slag-formable constituents.

Figure 6:
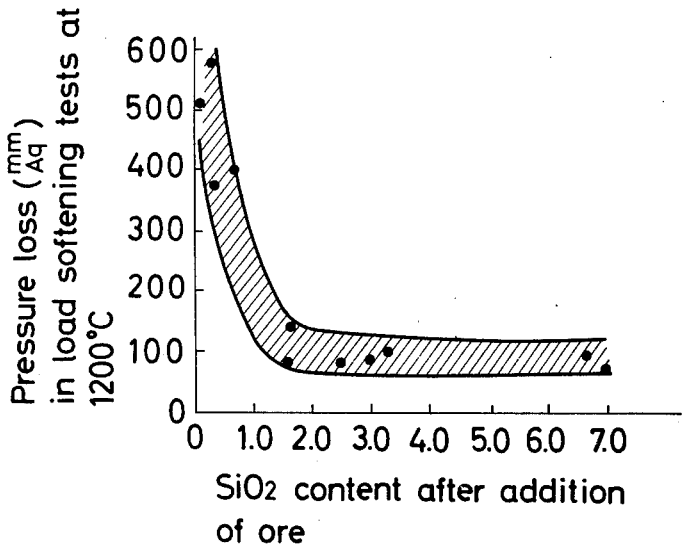
FIG. 6 is a graph showing a relationship between the concentration of $SiO_2$ in an iron ore blend and the pressure loss of pellets made up therefrom.
Figure 7:
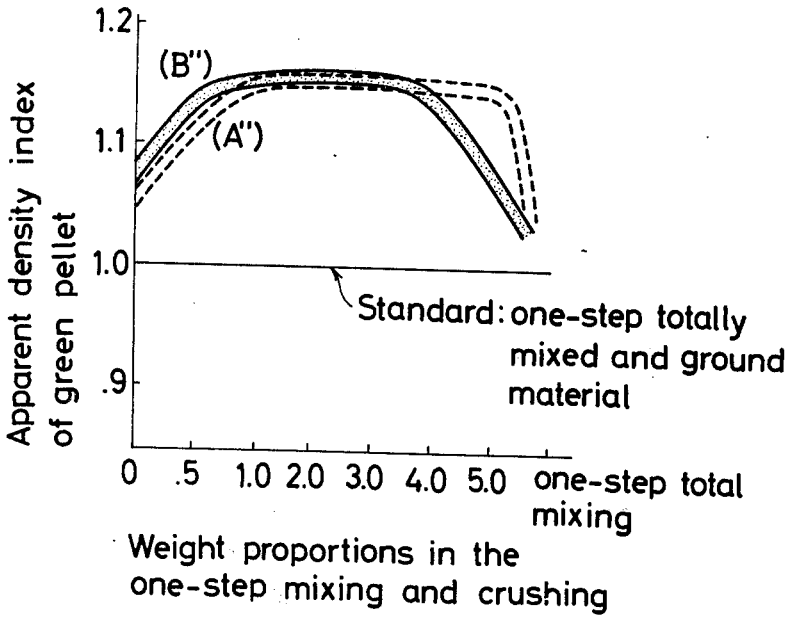
FIG. 7 is a graph showing the dependence of the apparent pellet density on the type of the pelletizing procedure and also the superiority of the two-step blending of the charge composition to the one-step blending.

In proportioning two or more iron ores to be blended, it is preferred that a concentration of $SiO_2$ not less than 1.5% is resulted in the blend prior to the mixing and grinding procedure in which a 9% hydraulic binder is added and in which the basicity is adjusted to not less than 1.2%, as shown in FIG. 6, wherein the adjustment of the basicity is effected by use of limestone. By taking into account the amount of slag which is to be produced when the resultant pellets are subjected to the smelting reactions in a furnace, it is preferred to adjust the concentration of $SiO_2$ in the blend to less than 7%.

EXAMPLE II

The four iron ores A', B', C' and D' were used in combination with Portland cement clinker as a hydraulic binder, limestone as a CaO-source material and seashore sand as a $SiO_2$-source material to prepare seven charge compositions as shown in Table 3 below, in which samples No. 1 through No. 4 have the blending aspect of the invention, while samples No. 5 through No. 7, though satisfying the requirement of the basicity of the invention, lack the blending aspect so that the amount of the slag-forming constituents in the samples No. 6 and No. 7 is as high as about 18% and 22% respectively.

Table 3

| Sample No. | Iron ore Type | Iron ore Ratio (%) | $SiO_2$ (%) | Binder (%) | Additive: Limestone (%) | Additive: Sand (%) | Factor: Slag (%) | Factor: CaO/$SiO_2$ | Factor: $SiO_2$ (%) |
|---|---|---|---|---|---|---|---|---|---|
| 1 | A'+B' | 40.0:51.1 | 2.02 | 9.0 | 0 | 0 | 12.70 | 1.30 | 4.54 |
| 2 | A'+C' | 68.0:23.0 | 2.72 | 9.0 | 0 | 0 | 13.29 | 1.56 | 4.55 |
| 3 | A'+D' | 46.0:45.0 | 3.33 | 9.0 | 0 | 0 | 13.15 | 1.25 | 4.91 |
| 4 | A'+D' | 45.0:44.0 | 3.33 | 9.0 | 2.0 | 0 | 13.87 | 1.52 | 4.69 |
| 5 | A' | 88.8 | 0.77 | 9.0 | 0 | 2.2 | 11.73 | 1.31 | 4.49 |
| 6 | B' | 87.5 | 4.78 | 9.0 | 3.5 | 0 | 18.33 | 1.54 | 6.08 |
| 7 | C' | 81.0 | 8.54 | 9.0 | 10 | 0 | 22.39 | 1.31 | 9.15 |

These charge compositions were formed into non-fired pellets in a manner similar to that shown in Example I, and the pellets were then subjected to the crushing test and the load softening test. The results are shown in Table 4 below.

Table 4

| Sample No. | Iron ore | Crushing strength of pellet after 7 days' curing (kg/P) | Pressure loss at 1200° C. ($mmH_2O$) | Concentration of $SiO_2$ in pellet[2] |
|---|---|---|---|---|
| 1 | A'+B' | 220 | 86 | 4.54 |
| 2 | A'+C' | 239 | 78 | 4.55 |
| 3 | A'+D' | 169 | 133 | 4.91 |
| 4 | A'+D' | 170 | 80 | 4.69 |
| 5 | A' | 199 | 303 | 4.49 |
| 6 | B' | 205 | 67 | 6.08 |
| 7 | C' | 227 | 60 | 9.15 |

As is evident from these Tables 3 and 4, the blending aspect of the invention is very effective for minimizing the concentration of $SiO_2$ in the pellet while still preserving the improved high-temperature properties thereof as defined by a pressure loss value lower than 200 $mmH_2O$ according to the load softening test.

The present invention has been described in connection with the principle of formulating the charge composition which is to be formed into non-fired pellets or briquettes, but it furthermore concerns a novel method of pelletizing the charge composition which method is particularly adapted for use on the compositional framework, that is, the requirements of control for the ratio in a range of from 1.2 to 1.9 and for the amount of slag-forming constituents in a range of from 13% to 19%.

As is known in the art, the as-formed discrete moist or "green" pellets are subsequently to be buried in a powder which serves as a matrix, until the curing of the cementitious material used as a binder in the pellets has been completed. The use of such a matrix gives rise to two main advantages, one of which is to avoid the adhesion of the pellets with one another during the curing procedure, and another advantage which is to prevent the deformation of the pellets and to decrease the percentage of crushed pellets as the pressure applied to a pellet is made uniform over the entire surface area thereof despite of the fact that the pellet is located under an accumulation of pellets. When the pellets are accumulated without using the matrix, as indicated by the experiments conducted by the present inventors, the green pellets produced by the conventional method and having a crushing strength of less than 1.0 kg per pellets at maximum tends upon accumulation at as high a level as more than two meters to gradually deform with progressive increase in the area of mutually contacting surfaces of the pellets. As a results, a number of huge blocks are formed, and the percentage of cracked pellets is increased.

With the blocked charge material, it is made more difficult to perform the travelling from the pelletizing system to the smelting system, and furthermore dividing and screening operations are required to perform prior to introduction into the furnace, whereby an excessive amount of fines are produced. such fines not only introduce handling difficulties but also contaminate the working environment. Moreover, the formation of the crackings in the pellets leads to a decrease in the crushing strength of the pellets themselves which also facilitates the production of fines to impaire the production efficiency because of the additional handling difficulties and the accumulation of the fines in the furnace. Such a situation will take on a new conditioning aspect of the furnace.

The present inventors have made many attempts to overcome such problems and have now found that when the crushing strength of the green pellets is increased and at the same time when the plasticity is decreased, the curing of the pellets may be performed in accumulation, whereby remarkably reducing the mutual adhesion of the pellets which would be otherwise effected and simultaneously availing of the rapidly decreased proportion of cracked pellets after the curing operation. For example, in the case of pellets having an average diameter of about 15 mm, a crushing strength of 2.0 kg-P at the as-formed state and a porosity of 30% permit for an accumulation of 2 meters high.

In order to impart to the as-formed moist pellets adequate crushing strength and porosity, it is found important to control the size and distribution of the particles of a given charge composition and the amount of water contained in the pellet, although other many factors affect the crushing strength and plasticity of the green pellets. With regard to this, it is preferred to increase the density of the charge composition prior to the pelletizing procedures, and then to adjust the amount of water in the green pellet to as low a level as possible while still satisfying the pellet-formable moisture range.

According to an embodiment of the present invention, the process for pelletizing a charge composition comprises proportioning a granulated iron ore, a hydraulic binder and one or more additives to adjust the basicity $CaO/SiO_2$ in a range of 1.2–1.9 and the amount of slag-forming constituents in the range of 13%–19%, mixing all of these materials at a time, and then grinding the mixture to obtain as uniform a distribution of the particle sizes as possible, and then forming the thus-ground mixture into discrete moist pellets having such a crushing strength and such a porosity as specified above. The performance of grinding of all the ingredients of a charge composition in the mixed form facilitates the minimization of the distribution range of qualities of the individual pellets which in turn leads to an increase of the average crushing strength level. A furthermore important aspect of this grinding procedure is to sustain the capillarity in the pellet as the compactness of the particles is improved to result in almost regular openings of correspondingly smaller size, thereby contributing an additional very effective factor to the improvement of the crushing strength. In addition thereto, the improved compactness assists in minimizing the necessary amount of water for moistening the ground mixture which in turn causes a decrease in the plasticity of the green pellet and the porosity thereof.

According to another embodiment of the invention, the grinding operation is divided into two successive steps when the nature of given raw materials for the charge composition does not permit the single-step grinding operation to provide the desired properties of the moist pellets in the as-formed state. An example of the two-step grinding operation is such that, in the first step, the total amount of the hydraulic binder, a fraction of the granulated ore and a fraction of the additive are ground in the mixed form to produce a powdery mixture which serves as a matrix for the remaining ore and additive in the second step. In this example, it is preferred that the sum of the first fractions of the ore and additive taken in the first step is in a range of from a one-fold to five-fold excess in relation to the total amount of the binder. As another example, in the first step, the sum of the total amounts of the binder and additive and a fraction of the granulated ore are ground in the mixed form to produce a powdery mixture which serves as a matrix for the remaining ore in the second step. In this second example, it is preferred that the first fraction of the ore used in the first step is in a range of from a $\frac{3}{4}$-fold to 4-fold excess in relation to the sum of the total amounts of the binder and additive. It is evident from FIG. 4 that the apparent density of the green pellets produced in the two-step grinding operation is relatively higher when the first step is operated with a mixture of the fractionated gredients in the proportion identified as preferable.

In some cases where no sufficient area of the plottage for the curing of the green pellets can be secured and therefore it cannot be helped to use a number of vertical curing containers such as hoppers or bins, it is required that the percentage of pellets mutually adhered after the curing be reduced to zero, or otherwise, even when the percentage is very small, the formation of a scaffold of pellets or the uneven downward advance thereof in the container would be resulted as the pellets are successively cut out from the bottom of the container, whereby introducing a handling difficulty. The present inventors have made many attempts to fulfill the requirement, and have now found that the application of an adherent coating of a very small thickness preferably of hot larger than 0.2 mm is very effective when a suitable organic material is selected for employment as the material of the coating. By the term "suitable", it is meant that the coating does not adversely affect the high-temperature properties of the resultant pellets, since the volume of the coating, though having as small a thickness as 0.2 mm, amounts to about 5% based on the volume of the bare pellet having a diameter of 15 mm. Experiments conducted by the present inventors indicate that as the suitable inorganic material, use may be made of a powdery mixture of the same iron ore and additive as those of the charge composition, a powdery iron ore or ores having a basicity of 1.2–1.9, or a powdery material selected from the group of limestone, slaked lime, dolomite, blast furnace slag and converter slag.

A coating apparatus which is found as suitable for good results with the above-identified coating material is of the continuously operated rotary drum type. The reason for this is that although the coating operation for the strongly adhered coating takes no more than 4 minutes, the coating thickness depends on the retention time so that when the retention time varies with different green pellets, the degree of cohesiveness of the coating to the pellet surface varies with the individual pellets to produce a bad influence on the high-temperature properties thereof. The utilization of an apparatus such as a pan pelletizer in which the retention and discharge depends on the pellet size distribution is undesirable, because the larger the diameter of a green pellet, the shorter the retention time, while the smaller the diameter, the pellet stays in the apparatus for a period longer than necessary. As a result, the range of thicknesses of the coatings is extended wider than that effected by the use of the rotary drum type coating apparatus.

It is important to control the amount of water with which the inorganic coating material is moistened before the application to the green pellets, although the moist coating material may be mixed with the green pellets either before or at charging into the coating apparatus. It is found that the acceptable moisture range is ±30% based on the amount of water contained in the green pellets. When the inorganic coating material is moistened with an amount of water less than the lower limit of the range, namely, for the green pellets containing 8% water, less than 5.5%, some of the water in pellet is rapidly transferred to the as-applied coating with the result that the coated green pellets tend to form crackings therein with decrease in the crushing strength of the green pellets. On the other hand, when the coating material is moistened with an amount of water more than the upper limit of the range, namely, for the equivalent green pellets to the above, more than 10%, a fraction of all of the moist coating material is formed into pellets by itself, and the coating operation is made more difficult to perform because of the high plasticity thereof.

It will be seen from the foregoing description that the present invention provides a process for making non-fired or cold pellets of high improved characteristics for use in a smelting furnace and particularly blast furnace from a charge composition of which the ingredients are proportionated to account for adjustment of the basicity $CaO/SiO_2$ and the slag-forming constituents, characterised as including a step of grinding the ingredients, in all, or fractionated amounts thereof with the successive stages, to produce a powdery mixture of such a nature that the green pellets made therefrom can be cured in an accumulation of more than 2 meters without causing excessive deformation thereof and the formation of crackings therein to splinters and without using a powdery matrix which would be otherwise necessary for the buring of the green pellets in the curing operation, whereby giving advantages that the production of fines from the cured pellets is minimized in the travelling and smelting procedures to minimize the handling difficulties and environmental pollution, and that the process is economical because of the high production efficiency. When the vertical curing containers are used, the pelletizing process may comprise an additional step of coating the green pellets by use of a continuously operated rotary drum. It is, of course, desirable to utilize the coating step in producing the coated green pellets which are to be cured in yards. In the latter connection, the cutting-out operation of the cured pellets followed by the travelling operation can be carried out very easily.

The present invention will now be further illustrated in and by the following examples of the pelletizing process. They are not intended to limit it in any manner.

EXAMPLE III

For accumulation curing in yard, a charge composition was made from the raw materials shown in Table 5 below to result in the constituents shown in Table 6 below.

Table 5

| Crypoilog iron ore | Furnace dust | Cement clinker | Limestone |
|---|---|---|---|
| 80.1% (by weight) | 4.5 | 8.7 | 6.7 |

Table 6

| T.Te | FeO | $SiO_2$ | $Al_2O_3$ | CaO | $CaO/SiO_2$ | Slag($SiO_2$+CaO+$Al_2O_3$) |
|---|---|---|---|---|---|---|
| 56.0 | 25.0 | 7.6 | 0.7 | 9.5 | 1.25 | 17.8 |

The charge composition was divided into equal three parts and the parts were subjected to different processes A,B and C.

In process A, all the raw materials were mixed and ground in a single step. In process B, the total amounts of the cement clinker and limestone were mixed with an equal amount of the ore thereto, and the mixture was grounded to produce a powdery mixture which was then mixed with the remaining ore and the total amount of the furnace dust. The Latter mixture was grounded to perform the second step of the grinding operation. In process C, all the raw materials were subjected to the mixing alone. The three specimens of the charge composition obtained from the processes A, B and C were pelletized under the same conditions by use of a pan pelletizer of 5 meters in diameter and the green pellets were accumulated in a height of 2 meters until the curing was completed. The results are shown in Table 7 below.

It is evident from Table 7 that the green and cured pellets according to process A of the invention are superior in crushing strength, cracking percentage and mutual adhesion to those of the process C of the Prior art, and that the pellets according to the process B employing the two-step mixing and grinding procedure of the invention are further improved over those of the process A particularly in cracking percentage and mutual adhesion.

Table 7

| | A | B | C |
|---|---|---|---|
| Particle size prior to pelletizing (−44μ%) | 83.2 | 85.1 | 78.9 |
| Green pellet: | | | |
| Crushing strength (kg/P) | 3.9 | 5.0 | 2.0 |
| dropping strength (frequency) | 5.3 | 6.7 | 4.5 |
| Porosity (%) | 26.4 | 25.3 | 30.2 |
| Moisture (%) | 8.5 | 7.5 | 9.0 |
| Crushing strength of the cured pellets after a day or days: | | | |
| 1 day | 35 | 40 | 15 |
| 2 days | 71 | 75 | 43 |
| 6 days | 100 | 110 | 64 |
| 10 days | 150 | 150 | 138 |
| Percentage of cracked pellets | 7.5 | 4.3 | 18.0 |
| Mutual adhesion of pellets | Slight | Very slight | Strong |
| Shutter test* after days passed | | | |
| 2 days (frequency) | 1 | 1 | 3 |
| 3 days (frequency) | 3 | 1 | 5 |
| 4 days (frequency) | 7 | 2 | 13 |
| Pressure loss according to the | | | |

Table 7-continued

| | A | B | C |
|---|---|---|---|
| load softening test ($mmH_2O$) | 160 | 160 | 190 |

Note:
*Using a shutter test machine, a block of pellets adhered with one another and having a weight of 40kg was dropped from a height of 2 meters in a frequency such that the block was splitted into the individual discrete pellets.

EXAMPLE IV

For the coating of green pellets to be cured in a hopper, the as-formed green pellets just after discharged from process B of Example III were mixed with a moist coating material shown in Table 8, and the mixture was thrown into a continuous type rotary drum of 1 meter in diameter and 3.5 meters long. After the duration of a time period of 2 minutes, the pellets were discharged therefrom in the as-coated state, and then accumulated in a hight of 3 meters in the hopper, while performing continuous cutting-out operation. The effective curing period in the hopper was about 30 days, and the cut-out masses of the pellets were further indurated in another curing facilities for 10 days. The results are shown in Table 9.

Table 8

| Coating composition | | | | | | | |
|---|---|---|---|---|---|---|---|
| | | | | | | Property | |
| Sample | | Constituents | | | | Basicity | Paricle size |
| No. | Raw material | T.Fe | FeO | CaO | $SiO_2$ | | (−44μ% by weight) |
| 1 | Powdered iron ore | 64.5 | 25.7 | 0.2 | 3.0 | 0.02 | 77.6 |
| 2 | Powdered iron ore + Limestone powder | 55.0 | 21.9 | 8.3 | 6.8 | 1.22 | 76.0 |
| 3 | Limestone powder | 0.7 | — | 54.4 | 0.1 | — | 67.0 |

Table 9

| Sample | 1 | 2 | | 3 |
|---|---|---|---|---|
| Moisture (%) | 4.5 | 7.2 | 6.5 | 8.7 |
| Percentage of coating weight based on green pellet weight (%) | 4.0 | 4.0 | 4.2 | 3.4 |
| Coated green pellet: | | | | |
| Crushing strength (kg/P) | 2.0 | 4.9 | 5.2 | 5.0 |
| Dropping strength (frequency) | 1.5 | 6.7 | 6.3 | 6.4 |
| Porosity(%) | 30.5 | 26.0 | 25.2 | 26.0 |
| Amount of water (%) | 7.2 | 7.6 | 7.8 | 7.5 |
| Crushing strength of the cured pellets after a day or days passed (kg/P) | | | | |
| 1 day | 15 | 42 | 45 | 40 |
| 2 days | 43 | 80 | 83 | 78 |
| 6 days | 61 | 120 | 120 | 115 |
| 10 days | 89 | 155 | 160 | 155 |
| Percentage of cracked pellets (%) | 85.0 | 0.1 | 0.3 | 0.1 |
| Mutual adhesion | Slight | none | none | none |
| Cutting-out from hopper | Bad (Scaffold) | Good | Good | Good |
| High-temperature properties | | | | |
| Pressure loss ($mmH_2O$) | 700 | 500 | 190 | 190 |
| Quality of pellet as estimated from interference with proper conditioning of blast furnace | Poor | Poor | Good | Good |

It is to be understood from the results shown above that the percentage of water contained in the coating composition is of importance in preventing a decrease of the crushing strength and the formation of crackings of the pellets and also in facilitating minimization of cutting-out difficulty of the indurated pellets from the curing hopper as the mutual adhesion of the green pellets is prevented, and that when the basicity of the coating composition is controlled so as not to be within the above specified range, poor high-temperature properties of the coated pellets result despite of the fact that the bare pellets without the coating have good high-temperature properties. In addition thereto, the screening operation of the indurated pellets can be omitted before the pellets are travelled from the pelletizing system to the smelting system, and the travelling is not suffered from the production of fines, whereby the handling difficulties which have so far encountered in the prior art are not introduced, and, moreover, the drafting aspect of the furnace is improved as the fines are not produced. Thus the present invention has accomplished a remarkable advance not only in the art but also in the economical and social aspects of the art.

What is claimed is:

1. In a method for making cold-bonded agglomerates in the form of pellets and briquettes for charging to blast and smelting furnaces wherein finely divided iron ore is blended with a cement type binder having hydraulic properties, the blend is moistened with an amount of water to provide agglomerates with sufficient strength, and the blend is formed into agglomerates and the agglomerates are then cured, the improvement consisting essentially of formulating said agglomerates so that the $CaO/SiO_2$ ratio is in the range from 1.2 to 1.9 and the amount of CaO, $SiO_2$ and $Al_2O_3$ is in the range from 13 to 19% based on the total weight of the cold-bonded agglomerate, said agglomerate having a softening tendency in terms of pressure loss value of less than 200 mm $H_2O$.

2. The method of claim 1 wherein the iron ore powder is blended with the binder and an additive selected from the group consisting of silica stone, beach sand, shirasu, blast furnace slag, electric furnace slag, dust from ferrosilicon production, serpentine, peridotite, limestone, quick lime, slaked lime, dolomite and converter slag.

3. A method according to claim 2, wherein the total amount of said binder is mixed with fractions of the total amounts of said iron ore powder and said additive, the sum of said fractions being equal to from 1 to 5 times the total amount of said hydraulic binder, and the mixture is ground to produce a uniform mixture into which the remaining amounts of said iron ore powder and said additive are added.

4. A method according to claim 2, wherein the sum of the total amounts of said binder and said additive is mixed with a fraction of the total amount of said iron ore powder, said fraction being equal to from $\frac{3}{4}$ to 4 times the sum of the total amounts of said hydraulic binder and said additive, and then the mixture is ground to produce a uniform mixture into which the remaining amount of said iron ore powder.

5. The method of claim 1 wherein the most pellets are coated with a moistened inorganic material in a continuous rotary drum such that the thickness of the coating is not thicker than 0.5 mm.

6. A method according to claim 5, wherein as the inorganic material, is a material selected from the group consisting of iron ore powder having a ratio $CaO/SiO_2$ of not less than 1.2, a mixture of an iron ore powder and an additive and having a ratio $CaO/SiO_2$ of not less than 1.2, $CaO_3$, $MgCO_3$ and $MgCO_3$ and $MgCO_3.CaCO_3$.

7. A method according to claim 5, wherein said inorganic material is moistened with an amount of water in a range of from $-30\%$ to $+30\%$ based on the amount of water contained in the as-formed moist agglomerates.

8. Cold-bonded agglomerates produced by the method of claim 1.

9. In a method for making cold-bonded agglomerates in the form of pellets and briquettes for charging to blast and smelting furnaces wherein finely divided iron ore is blended with a cement type binder having hydraulic properties, the blend is moistened with an amount of water to provide agglomerates with sufficient strength, and the blend is formed into agglomerates and the agglomerates are then cured, the improvement consisting essentially of forming the blend by mixing Fe-rich low $SiO_2$ powdered ore with iron ore powder containing $SiO_2$ as a gangue in a blending ratio such that the $SiO_2$ content in the resultant blend is not less than 1.5% and then adding CaO to the blend in an amount to maintain the $CaO/SiO_2$ ratio in the range from 1.2 to 1.9 and controlling the total amount of CaO, $SiO_2$ and $Al_2O_3$ in the range from 13 to 19% based on the total cold-bonded agglomerates, said agglomerate having a softening tendency in terms of pressure loss value of less than 200 mm $H_2O$.

* * * * *